US008826916B2

(12) United States Patent
Inagaki et al.

(10) Patent No.: US 8,826,916 B2
(45) Date of Patent: Sep. 9, 2014

(54) FILTER FOR SMOKING

(75) Inventors: Michihiro Inagaki, Tokyo (JP); Takashi Hasegawa, Tokyo (JP); Kazunori Sugai, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 1053 days.

(21) Appl. No.: 11/070,192

(22) Filed: Mar. 3, 2005

(65) Prior Publication Data

US 2005/0145260 A1 Jul. 7, 2005

Related U.S. Application Data

(63) Continuation of application No. PCT/JP03/10877, filed on Aug. 27, 2003.

(30) Foreign Application Priority Data

Sep. 4, 2002 (JP) ..... 2002-258988

(51) Int. Cl.

| | |
|---|---|
| ***A24D 3/04*** | (2006.01) |
| ***A24F 13/04*** | (2006.01) |
| ***A24D 3/06*** | (2006.01) |
| *A24F 47/00* | (2006.01) |

(52) U.S. Cl.

CPC ..... *A24F 13/04* (2013.01); *A24D 3/067* (2013.01); *A24F 47/008* (2013.01); *A24D 3/04* (2013.01)

USPC ..... 131/341; 131/331; 131/344

(58) Field of Classification Search

CPC ..... A24D 3/067; A24F 47/008

See application file for complete search history.

(56) References Cited

U.S. PATENT DOCUMENTS

| | | | | |
|---|---|---|---|---|
| 4,215,708 | A | 8/1980 | Bron | |
| 5,392,793 | A * | 2/1995 | Molloy | 131/339 |
| 5,567,231 | A | 10/1996 | Yokoo et al. | |
| 5,746,231 | A * | 5/1998 | Lesser et al. | 131/334 |

FOREIGN PATENT DOCUMENTS

| | | | |
|---|---|---|---|
| CN | 1061331 | A | 5/1992 |
| EP | 0482872 | A1 | 4/1992 |
| FR | 820 402 | A | 11/1937 |
| GB | 1 592 157 | A | 7/1981 |
| JP | 60-110333 | A | 6/1985 |
| JP | 62-79766 | A | 4/1987 |
| JP | 4-262773 | A | 9/1992 |
| JP | 2001-165 | A | 1/2001 |
| RU | 2155529 | C2 | 9/2000 |
| TW | 138819 | A | 8/1990 |
| WO | WO-98/15197 | A1 | 4/1998 |

OTHER PUBLICATIONS

Baker, Richard R., "The Release of Nicotine and Semivolatile Components Inside a Burning Cigarette", 1999, British American Tobacco Documents Archive, Regents of the University of California, http://bat.library.ucsf.edu/tid/rao17a99.*

Taiwan Patent Office, Decision of Rejection, Jun. 8, 2004, Taiwan.

(Continued)

*Primary Examiner* — Michael J Felton

(74) *Attorney, Agent, or Firm* — Birch, Stewart, Kolasch & Birch, LLP

(57) ABSTRACT

A filter for smoking includes a filter medium, and a means for heating the filter medium or a periphery of the filter medium.

5 Claims, 5 Drawing Sheets

(56) References Cited

OTHER PUBLICATIONS

Taiwan Patent Office, Decision of Rejection. Nov. 23, 2004, Taiwan.

Supplementary European Search Report date May 11, 2011 issued in corresponding European Patent Application No. 03794103.6.

* cited by examiner

FILTER FOR SMOKING

CROSS-REFERENCE TO RELATED APPLICATIONS

This is a Continuation Application of PCT Application No. PCT/JP03/10877, filed Aug. 27, 2003, which was published under PCT Article 21(2) in Japanese.

This application is based upon and claims the benefit of priority from prior Japanese Patent Application No. 2002-258988, filed Sep. 4, 2002, the entire contents of which are incorporated herein by reference.

BACKGROUND OF THE INVENTION

1. Field of the Invention

The present invention relates to a filter for smoking.

2. Description of the Related Art

For removing the harmful substances from tobacco smoke, it has been proposed to add various adsorbents and modifiers to filters for cigarettes.

However, since the components having a high boiling point, e.g., benzo[a]pyrene, exhibits behavior equal to that of particles, it was difficult to remove selectively the components having a high boiling point by using the conventional tobacco filter.

Japanese Patent Disclosure No. 60-110333, for example, discloses a tobacco filter made of acetate fiber carrying granular blue-green alga Spirulina. It is reported in this prior art that a tobacco smoke was passed through a pipe provided with a filter carrying the blue-green alga Spirulina so as to determine the adsorption removal rate relative to the filter that did not carry the blue-green alga Spirulina. The removal rates are 42.4% for nicotine, 53.2% for tar, and 75.1% for 3,4-benzopyrene.

On the other hand, Japanese Patent Disclosure No. 62-79766 proposes a tobacco filter prepared by rolling a sheet carrier carrying floc of Fomes annosus/Ganoderma lucidum mixture or powder/floc of Coriolus versicolor. It is reported that the removal rate of 3,4-benzopyrene was 62% and 35% for the respective filters.

However, the conventional tobacco filters exemplified above are incapable of sufficiently removing the high boiling point components from the tobacco smoke.

BRIEF SUMMARY OF THE INVENTION

According to an embodiment of the present invention, there is provided a filter for smoking, comprising a filter medium, and a means for heating the filter medium or a periphery of the filter medium.

The means for heating the periphery of the filter medium used in the present invention is not for directly heating the filter medium but includes, for example, a smoking article (cigarette holder) for indirectly heating from the outside the filter medium wrapped with a chip paper.

In the smoking filter of the present invention, it is desirable for the filter medium to be formed of heat resistant fibers. It is desirable for the filter formed of heat resistant fibers to exhibit thermal stability such that the filter is not modified even when heated to about 300° C.

In the smoking filter of the present invention, it is desirable for the filter medium to be a high efficiency filter capable of removing substantially 100% of particles. The term "high efficiency filter" means a filter capable of removing substantially 100% of particle components contained in the tobacco smoke and capable of delivering vapor components substantially completely. It is possible for the fiber diameter and the ventilation resistance of the high efficiency filter to be substantially equal to those of the ordinary filter medium. To be more specific, the high efficiency filter preferably has a fiber diameter of sub-microns to scores of microns and the ventilation resistance not higher than 200 $mmH_2O$.

Also, it should be noted that, since the present invention is characterized in that filtration is performed so as to change gas-liquid distribution of the smoke through heating, it is possible to expect the same effect even when heated smoke is passed through a filter medium that is not heated. Such being the situation, it is possible to heat the smoke before it passes through the filter medium so as to change the gas-liquid distribution, followed by passing the smoke through the filter medium. To be more specific, it is possible to arrange the high efficiency filter immediately rearward of a combustion cone. For example, since a smoke-generating portion does not move in the case of an aerosol cigarette such as AIRS (registered trade mark), it suffices to arrange the high efficiency filter immediately rearward of the smoke-generating portion. Also, if the high efficiency filter is used in combination with a low ignition wrapper, it is possible to arrange the filter medium by making a tobacco section sufficiently short because the natural combustion rate is low.

It is desirable for the heating means used in the smoking filter of the present invention to be capable of controlling the temperature of the filter medium within a range of between 100° C. and 200° C. The filter temperature may be regulated in a two-stage manner such as 200° C. and 100° C. The smoking filter of the present invention may further comprise a cooling section. Still further, it is possible for the smoking filter of the present invention to be used in combination with charcoal, layered phosphate and other additives.

According to the present invention, applying such heat that permits evaporating necessary components, which contribute tobacco aroma and/or taste, and does not evaporate the high boiling point components can selectively filter the components having a high boiling point.

DETAILED DESCRIPTION OF THE INVENTION

Examples of the present invention will now be described with reference to the accompanying drawings.

Figure 1:
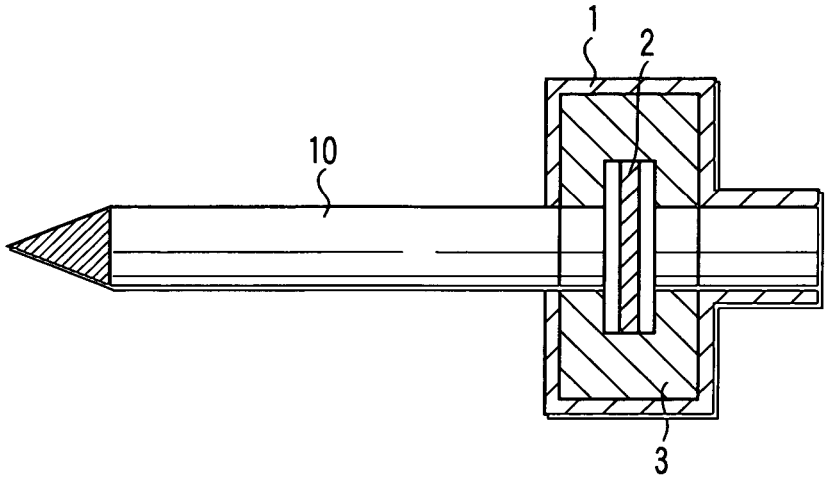
FIG. 1 shows a state that a cigarette is mounted to a smoking filter according to an embodiment of the present invention.

FIG. 1 shows a state that a cigarette is mounted to a smoking filter according to an embodiment of the present invention. As shown in FIG. 1, an HEPA filter (a High Efficiency Particulate Air filter) used as a high efficiency filter 2 and a heater 3 surrounding the high efficiency filter 2 are arranged inside the smoking filter 1. A cigarette 10 is mounted to the tip of the smoking filter 1. In smoking, the high efficiency filter 2 is heated by the heater 3.

Figure 2:
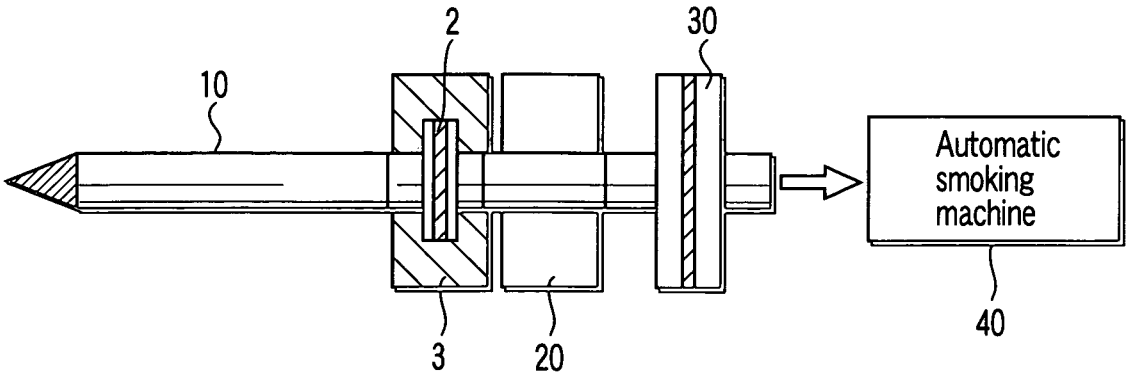
FIG. 2 shows the construction of equipment used for automatic smoking experiments.

Automatic smoking experiments were conducted by using equipment constructed as shown in FIG. 2. As shown in FIG. 2, a cooler 20 set at 22° C. and a Cambridge filter 3 were mounted to the rear stage of the smoking filter 1 shown in FIG. 1, and an automatic smoking machine 40 was connected to the system. An untipped cigarette was mounted to the smoking filter 1 as the cigarette 10. Under the particular conditions, automatic smoking was performed by setting the high efficiency filter at various temperatures falling within a range of between 22° C. (non-heating) and 300° C. The filter temperature was kept constant during the automatic smoking for 6 minutes (6 puffs).

Figure 3:
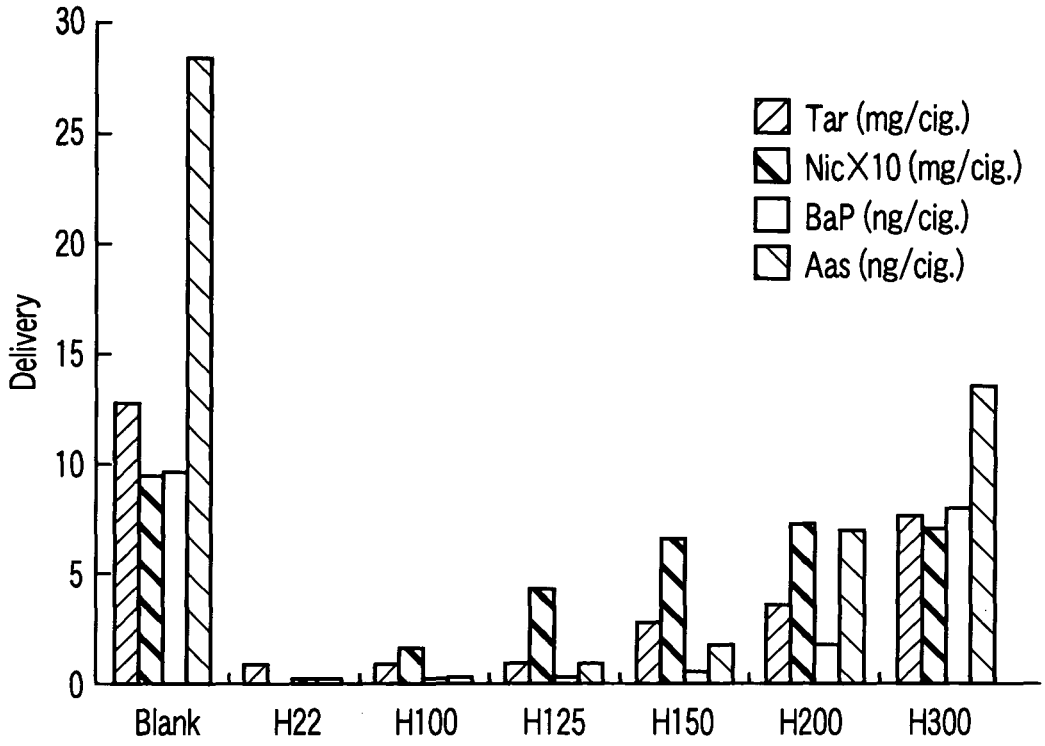
FIG. 3 is a graph showing the relationship between the filter temperature and delivery of each component.

FIG. 3 is a graph showing the relationship between the filter temperature and delivery of each of tar (Tar), nicotine (Nic), benzo[a]pyrene (BaP), and aromatic amines (Aas). Incidentally, the indication "blank" shown in the graph denotes the result, covering the case where the automatic smoking was performed at 22° C. without the HEPA filter. Also, the indication "H22" etc. denotes the temperature set for the high efficiency filter (HEPA filter).

FIG. 3 shows that, although delivery of each component was small where the temperature of the high efficiency filter was set at 22° C., delivery of each component was increased with increase in the temperature of the high efficiency filter. The experimental data reflect the characteristics of the high efficiency filter, i.e., the characteristics that the high efficiency filter removes substantially 100% of particles and permits penetrating almost all vapor components with some exceptions. The evaporation of each of tar, nicotine, benzo[a] pyrene and aromatic amines is increased with the temperature elevation so as to increase the delivery of each of these components. Since the components of the tobacco smoke differ from each other in the evaporating temperature, it is reasonable to understand that the components having a high boiling point can be selectively removed if the high efficiency filter is heated appropriately such that the necessary components can be evaporated and that the high boiling point components are not evaporated.

Figure 4:
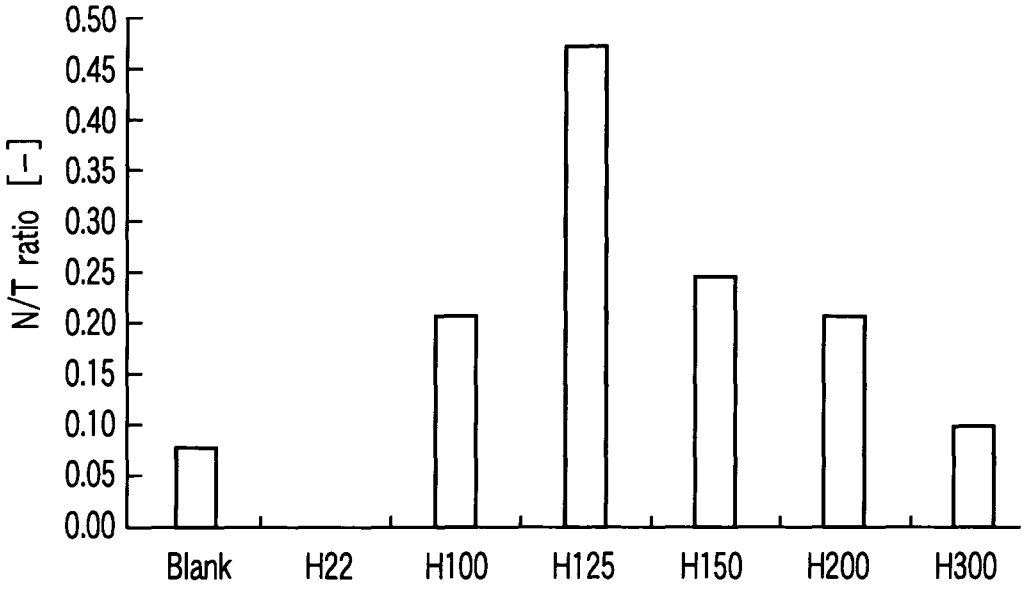
FIG. 4 is a graph showing the relationship between the filter temperature and the ratio in delivery of nicotine to tar (N/T ratio)

FIG. 4 is a graph showing the relationship between the filter temperature and a ratio in delivery of nicotine to tar (N/T ratio). Thousands of components are contained in tar, and these components differ from each other in the evaporating temperature. Such being the situation, tar and nicotine differ from each other in delivery dependent on the temperature. As apparent from FIG. 4, the highest N/T ratio was reached in the case where the filter temperature was set at 125° C., and it was about 8 times as high as the N/T ratio for the case of blank.

In other words, it is possible to selectively penetrate necessary components, which contribute to tobacco aroma and/or taste, having a boiling point lower than that of nicotine by heating the filter medium so as to filter non-volatile components in tar.

Figure 5:
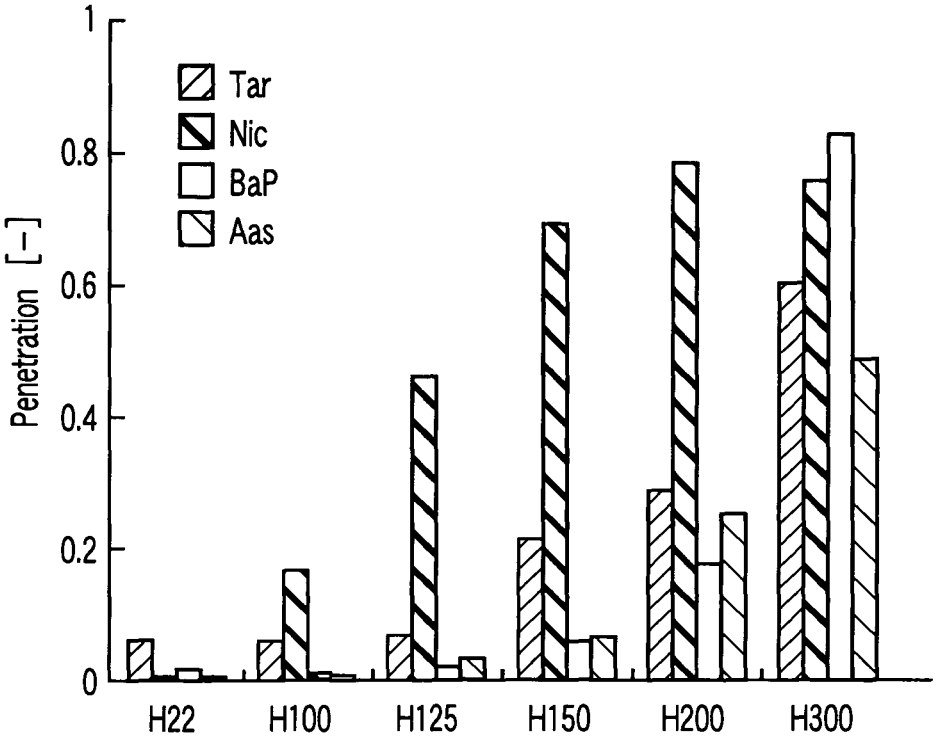
FIG. 5 is a graph showing the relationship between the filter temperature and penetration of each component.

FIG. 5 is a graph showing the relationship between the filter temperature and the penetration of each of the components of the tobacco smoke. In FIG. 5, the penetration of each of tar (Tar), nicotine (Nic), benzo[a]pyrene (BaP) and aromatic amines (Aas) is shown as a relative value, with the penetration for the black case set at 1. Nicotine is scarcely penetrated at 22° C. However, the penetration of nicotine is increased to about 0.2 at 100° C., to about 0.5 at 125° C., and to about 0.8 at 200° C., which represents remarkable increase in penetration with temperature. In the case where the temperature of the HEPA filter is set to 200° C. or more, nicotine is not detected in the HEPA filter, which can be interpreted that almost all nicotine is penetrated through the HEPA filter. However, it is believed that a part of penetrated nicotine may be adhered to a conduit etc. resulting in loss, which brings penetration at 200° C. or more to be about 0.8. Also, it is believed that the reason why penetration values of tar, benzo [a]pyrene and aromatic amines do not reach unity even at 300° C. attributes to insufficient evaporation thereof and loss due to adhesion to a conduit. If the filter temperature is set within a range of between 125° C. and 150° C., benzo[a] pyrene and aromatic amines that are undesirable in smoking is scarcely penetrated, and the necessary components, which contribute to tobacco aroma and/or taste, having a boiling point lower than that of nicotine can be selectively penetrated. Also, the effect of the selective penetration described above can be obtained if the filter temperature is set within a range of between 100° C. and 200° C.

Incidentally, in the experiments reported above, the filter temperature was controlled constant throughout the first puff to the sixth puff. However, it is considered reasonable that the similar effect can be obtained even if the filter is kept heated to a prescribed temperature, e.g., 125° C., for only a short time in each puff.

Figure 6:
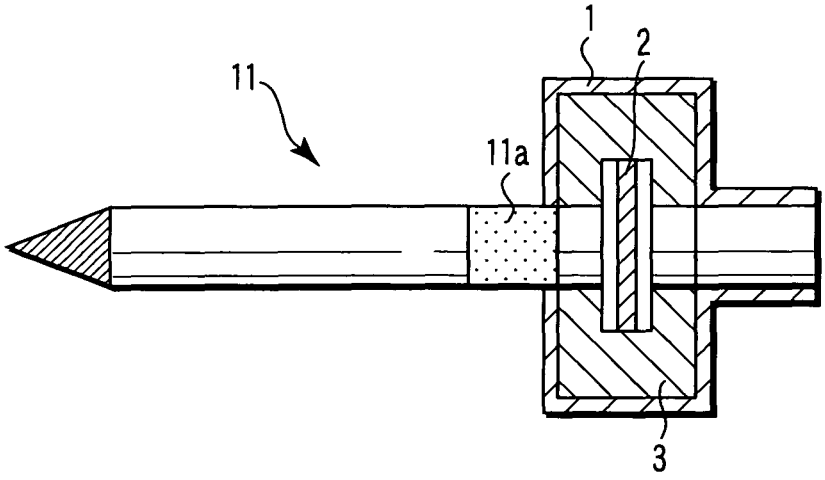
FIG. 6 shows a state that another cigarette is mounted to the smoking filter according to an embodiment of the present invention.
Figure 7:
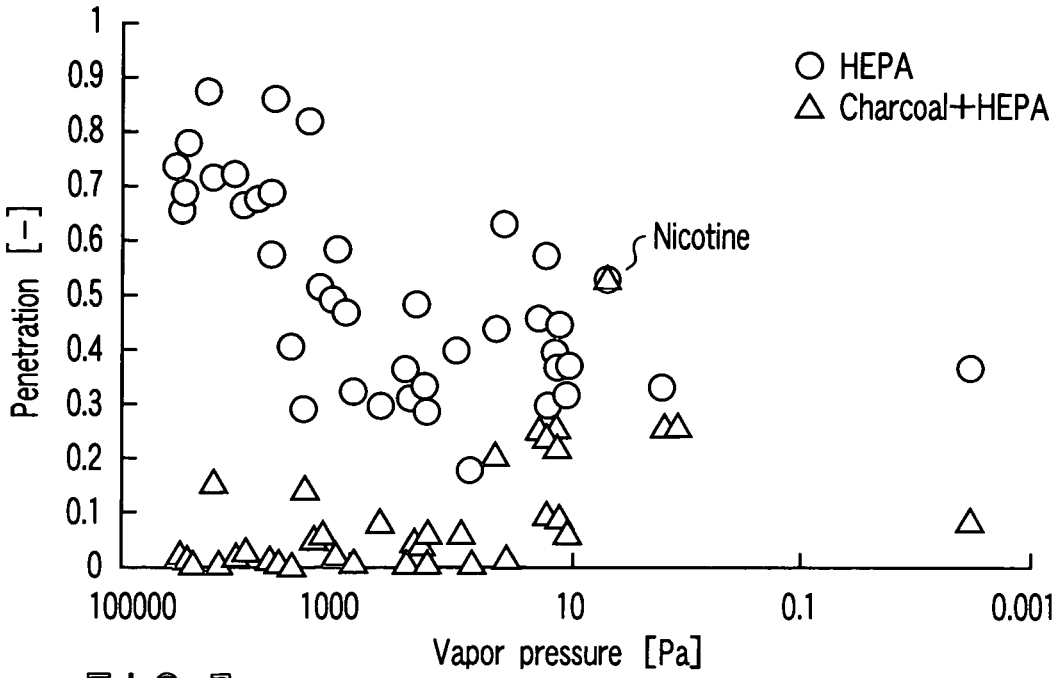
FIG. 7 is a graph showing the relationship between the vapor pressure of each smoke component and penetration thereof.
Figure 8:
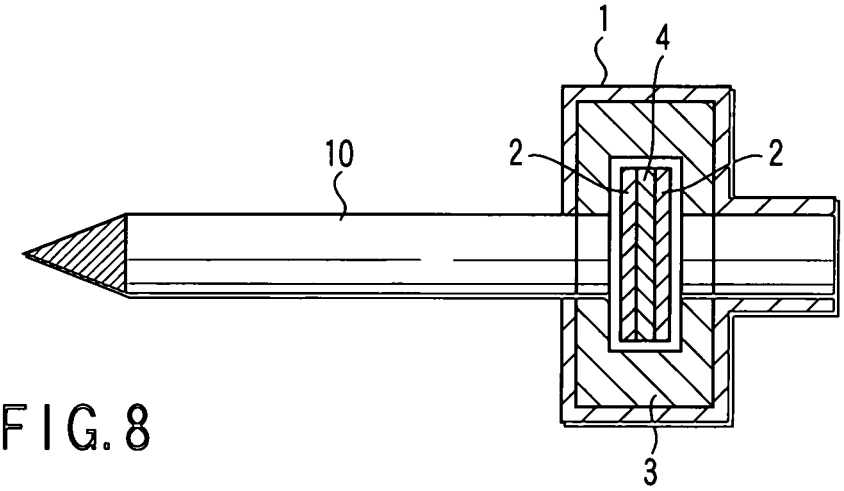
FIG. 8 shows a state that zirconium phosphate is added to the smoking filter according to an embodiment of the present invention.

Next, a construction in which the untipped cigarette 10 was mounted to the smoking filter 1 as shown in FIG. 1 and another construction in which a cigarette 11 including a charcoal filter 11*a* is mounted to the smoking filter 1 as shown in FIG. 6. In each construction, the high efficiency filter medium was heated to 200° C. so as to make one puff, and the penetrated tobacco smoke was collected. The collected tobacco smoke was analyzed by GC/MS so as to evaluate the relationship between the vapor pressure and the penetration for each vapor component. FIG. 7 shows the results.

Where a charcoal filter was not arranged in the front of the high efficiency filter medium, a tendency that the component having the higher vapor pressure exhibited the higher penetration was observed. On the other hand, where a charcoal filter was arranged in the front of the high efficiency filter medium, it be found possible to selectively filter the components having a high vapor pressure in spite of the fact that the penetration of nicotine was substantially equal to that for the former case. In other words, it has been found possible to control the components in both particle phase and vapor phase in the case where the smoking article provided with the heating means defined in the present invention is used in combination with an adsorbent/additive represented by charcoal.

FIG. 7 shows that penetration not lower than 1 was not recognized. This supports that, even if the high efficiency filter medium is heated to 200° C., anomalous components formed by heat reaction are not present within the range of this measurement.

Next, zirconium phosphate 4 (available from Daiichi Kigenso Kagakukogyo Co., LTD., CPZ-100), which is a layered phosphate, was sandwiched between two HEPA filters 2. Then, automatic smoking experiments were conducted by using equipment of the construction shown in FIG. 2 with the temperature of the HEPA filter set at 200° C.

Figure 9:
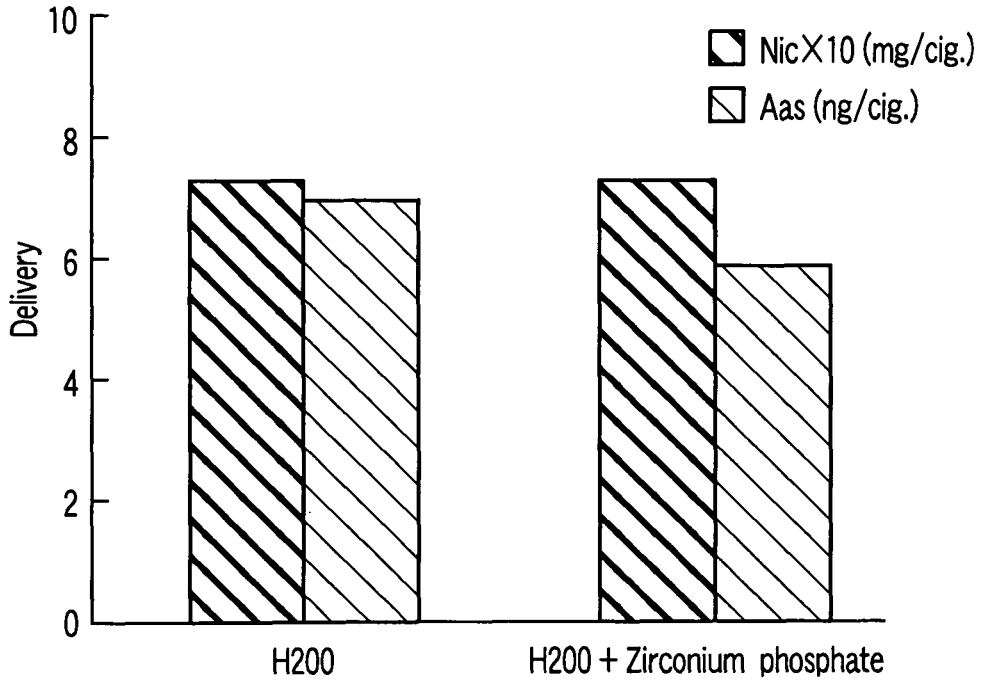
FIG. 9 is a graph showing delivery of nicotine and aromatic amines through smoking filter with zirconium phosphate or without zirconium phosphate.

FIG. 9 is a graph showing delivery of nicotine and aromatic amines through HEPA filter with zirconium phosphate in relative to that without zirconium phosphate. FIG. 9 supports that a selective removal of aromatic amine can be expected without substantial change in penetration by adding zirconium phosphate in the HEPA filter. Also, it is conceivable such an application that an oxidation catalyst effectively acting at higher temperatures is added in the HEPA filter, wherein carbon monoxide, which is undesirable in smoking, is converted into carbon dioxide.

Figure 10:
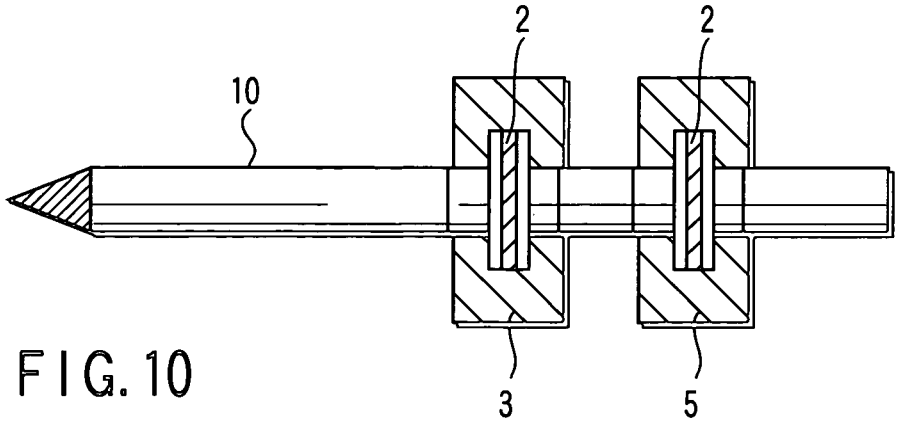
FIG. 10 shows a state in which the smoking filter according to an embodiment of the present invention is temperature controlled in a two-stage manner.

FIG. 10 shows an example in which two units of the smoking filters each having a high efficiency filter 2 and a heater 3, 5 surrounding the high efficiency filter 2. Here, the upstream filter is set to relatively high temperature (200° C.) and the downstream filter is set to relatively low temperature (100° C.). In this case, the upstream filter serves to selectively penetrate the necessary components, which contribute to tobacco aroma and/or taste, having a boiling point lower than that of nicotine with respect to the high boiling point components, while the downstream filter serves to selectively condense a part of high boiling point components penetrated from the upstream filter.

Figure 11:
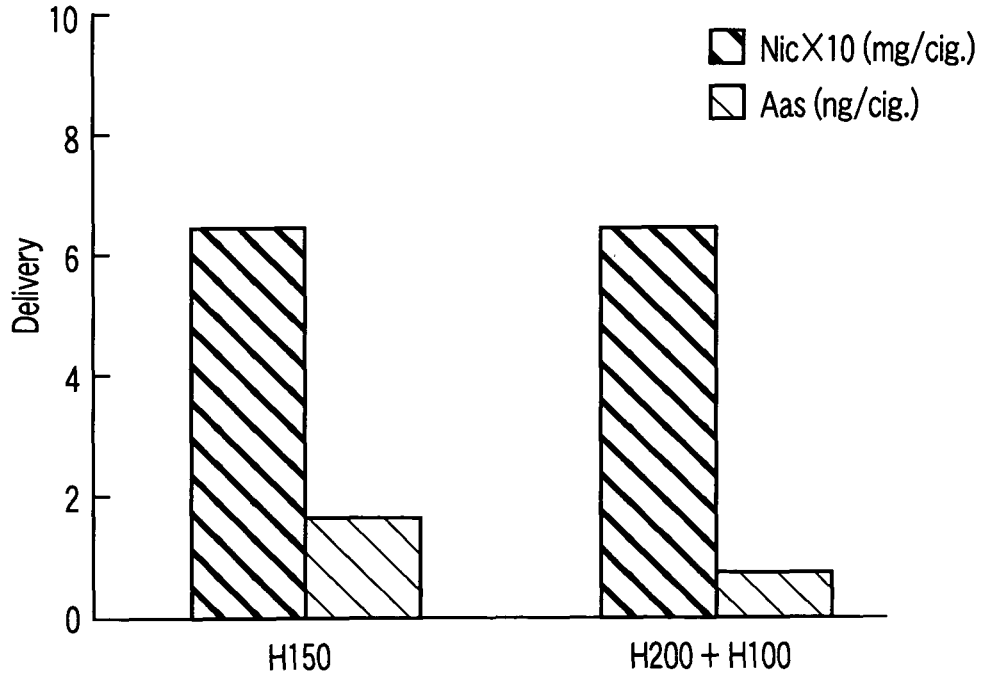
FIG. 11 is a graph showing delivery of nicotine and aromatic amines through smoking filters under one-stage temperature control and under two-stage temperature control, respectively.

FIG. 11 is a graph showing results of delivery of nicotine and aromatic amines through smoking filter under two-stage temperature control, compared with the results under one-stage temperature control at 150° C. (H150), where the delivery of nicotine is nearly equal to that of the aromatic amines. FIG. 11 shows that the two-stage temperature control can suppress the delivery of aromatic amines by selective condensation of high boiling point components at the downstream filter, without substantial change in delivery of nicotine. The result represents effectiveness for smoke component control by multi-stage temperature control.

The description given above covers the case where a high efficiency filter medium (HEPA filter), which permits removing substantially 100% of the particle components in the tobacco smoke and also permits penetrating the vapor components substantially completely, is heated. However, it is conceivable to remove about 50% of the undesired component such as benzo[a]pyrene and aromatic amines, while penetrating almost all components, which contribute to tobacco aroma and/or taste, having a boiling point lower than that of nicotine.

What is claimed is:

1. A filter for smoking, comprising:

a filter medium formed of heat resistant fibers that is a high efficiency filter capable of removing substantially 100% of particles and capable of delivering vapor components substantially completely; and a heater heating the filter medium and a periphery of the filter medium, the heater completely surrounding the periphery of the filter medium and being capable of controlling the temperature within a range of between 125° C. and 150° C., wherein the filter medium selectively removes high boiling point components in a smoke.

2. The filter for smoking according to claim 1, which further comprises a cooling section.

3. The filter for smoking according to claim 1, which further comprises a charcoal filter.

4. The filter for smoking according to claim 1, which comprises a first upstream filter medium set at a first temperature and a second downstream filter medium set at a second temperature lower than said first temperature, which selectively condenses a part of high boiling point components in a smoke.

5. The filter for smoking according to claim 1, wherein the high boiling point components include benzo[a]pyrene and aromatic amines.

* * * * *